United States Patent [19]

Meili

[11] Patent Number: 4,625,356

[45] Date of Patent: Dec. 2, 1986

[54] MOP AND SQUEEZE COMBINATION

[75] Inventor: Hermann Meili, Münchwilen, Switzerland

[73] Assignee: Lever Brothers Company, New York, N.Y.

[21] Appl. No.: 742,369

[22] Filed: Jun. 10, 1985

Related U.S. Application Data

[63] Continuation of Ser. No. 601,199, Apr. 17, 1984, abandoned.

[30] Foreign Application Priority Data

Apr. 18, 1983 [GB] United Kingdom ..... 8310475

[51] Int. Cl.[4] ..... A47L 13/14

[52] U.S. Cl. ..... 15/119 A; 15/244 A; 15/260

[58] Field of Search ..... 15/119 A, 116 R, 116 A, 15/147 R, 150, 228, 229, 260, 261

[56] References Cited

U.S. PATENT DOCUMENTS

| | | | |
|---|---|---|---|
| 2,163,638 | 6/1939 | Vaughn | 15/260 X |
| 2,220,401 | 11/1940 | Fouke | 15/260 |
| 2,577,496 | 12/1951 | Wolfer | 15/260 |
| 2,714,736 | 8/1955 | Johnson | 15/119 A |
| 2,851,710 | 9/1958 | Leach | 15/260 X |
| 3,050,761 | 8/1962 | Morgan | 15/119 A |
| 3,341,876 | 9/1967 | Campbell | 15/260 X |
| 4,356,586 | 11/1982 | Klotz | 15/119 A |

FOREIGN PATENT DOCUMENTS

| | | |
|---|---|---|
| 330543 | 6/1930 | United Kingdom . |
| 1168635 | 11/1966 | United Kingdom . |
| 1095542 | 12/1967 | United Kingdom . |

*Primary Examiner*—Chris K. Moore

*Attorney, Agent, or Firm*—James J. Farrell

[57] ABSTRACT

The invention pertains to a mop and in particular to an improved mop and squeezing device combination, the mop comprising a backing plate, an absorbent body attached thereto, a handle pivotally connected to the backing plate, and one or more arms rigidly attached to the lower end of the handle, the combination of the handle and the arms forming a lever, the arms being co-operable with an auxiliary abutment so that pivoting movement of the handle causes a downward pressure onto the backing plate for squeezing the absorbent body; the squeezing device comprising a, preferably arcuate squeezing plate, a holder therefor and optionally one or more squeezer arms rigidly attached to the holder which are cooperable with the lever arms. The mopping device requires only limited force to accomplish complete squeezing-out of the absorbent body and provides improved removal of dirt from the absorbent body.

9 Claims, 11 Drawing Figures

MOP AND SQUEEZE COMBINATION

This is a continuation of Ser. No. 601,199, filed Apr. 17, 1984, now abandoned.

The invention relates to a mopping device and in particular to a mop and an improved squeezing device therefor.

Heretofore various attempts have been made to design a mop and squeeze combination consisting of a mop and a squeezing device either mounted as a fixture on the mop itself or co-operating therewith as a detached unit. On a number of scores, however, previous devices appear not to give complete satisfaction. Thus, during the squeezing-out operation, the dirt that has usually collected on the four sides of the mopping body, such as e.g. a sponge, is often not squeezed out of the sponge but into the sponge. Similarly, the squeezing force which has to be exerted by the user is often very considerable, while furthermore it is very difficult to achieve complete squeezing-out of the dirty liquid.

The principal object of the present invention is to provide a mopping device which requires limited force to accomplish complete squeezing-out. Another object is the provision of such arrangement that during the squeezing operation the dirt is transported from the middle of the mopping body in outward direction.

Accordingly, the present invention provides a mop comprising a backing plate, an absorbent body attached thereto, a handle pivotally connected to the backing plate, and one or more lever arms rigidly attached to the lower end of the handle, the combination of the handle and the lever arms forming a lever, the lever arms being co-operable with an auxiliary abutment so that pivoting movement of the handle causes a downward pressure onto the backing plate for squeezing the absorbent body.

Furthermore, a mop and squeeze combination is provided comprising a mop as described above and an accessory squeezing device comprising a squeezing plate and a holder therefor.

Generally, the squeezing device further comprises one or more overhanging squeezer arms rigidly attached to the squeezing plate holder which are co-operable with the lever arms during the squeezing-out operation.

The invention will now be described in more detail with reference to the accompanying drawings showing two preferred embodiments.

Figure 3A:
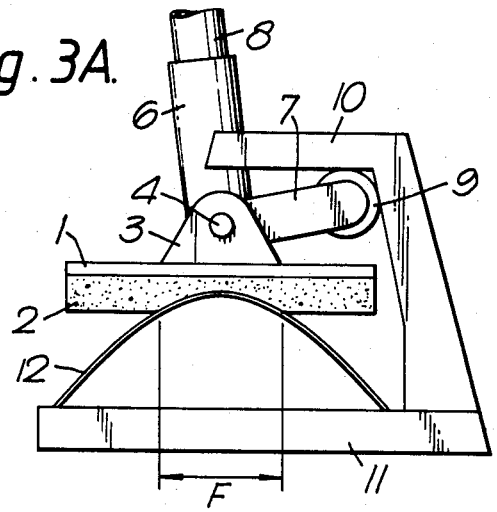
Figure 3B:
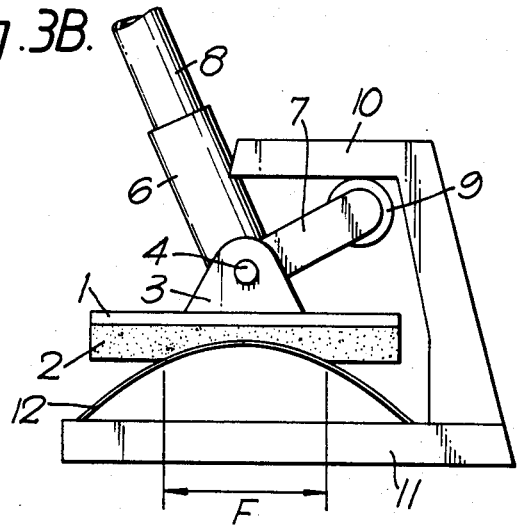
Figure 3C:
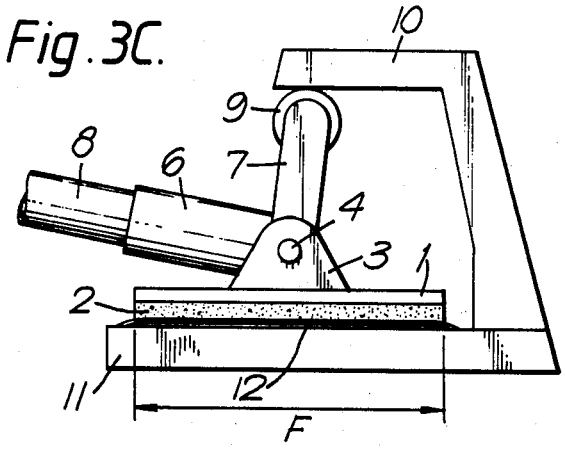

FIGS. 3*a*, 3*b* and 3*c* show, in a side elevation, the cooperation between the mop and the squeezing device in successive stages of the squeezing-out operation.

Figure 4:
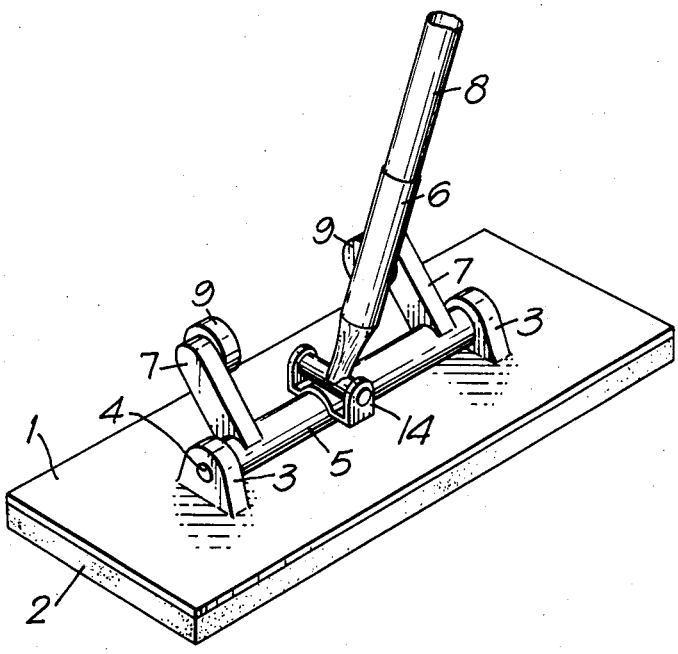

FIG. 4 is a view in perspective of the lower portion of the mop with part of the handle, the mop now being equipped with a universal joint.

Figure 5:
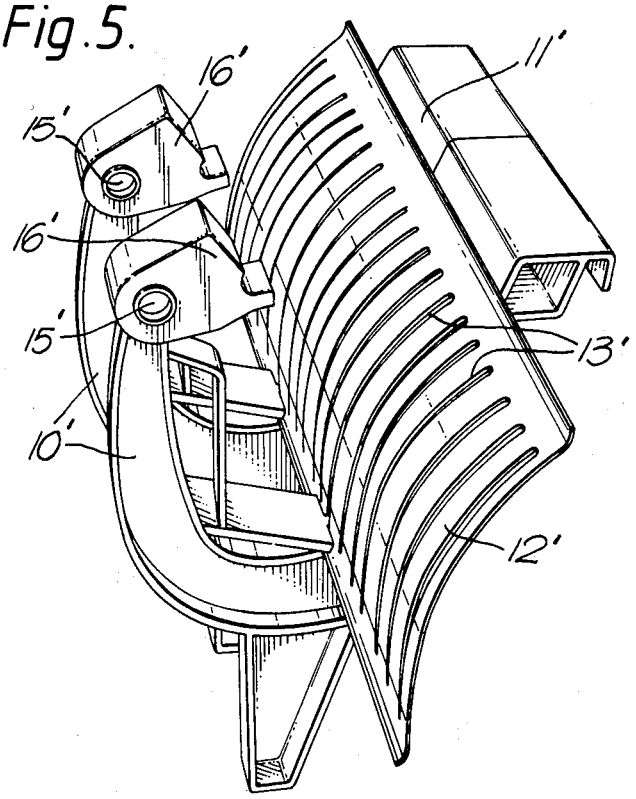

FIG. 5 is a view in perspective of a second preferred embodiment of a squeezing device in accordance with the present invention.

Figure 6:
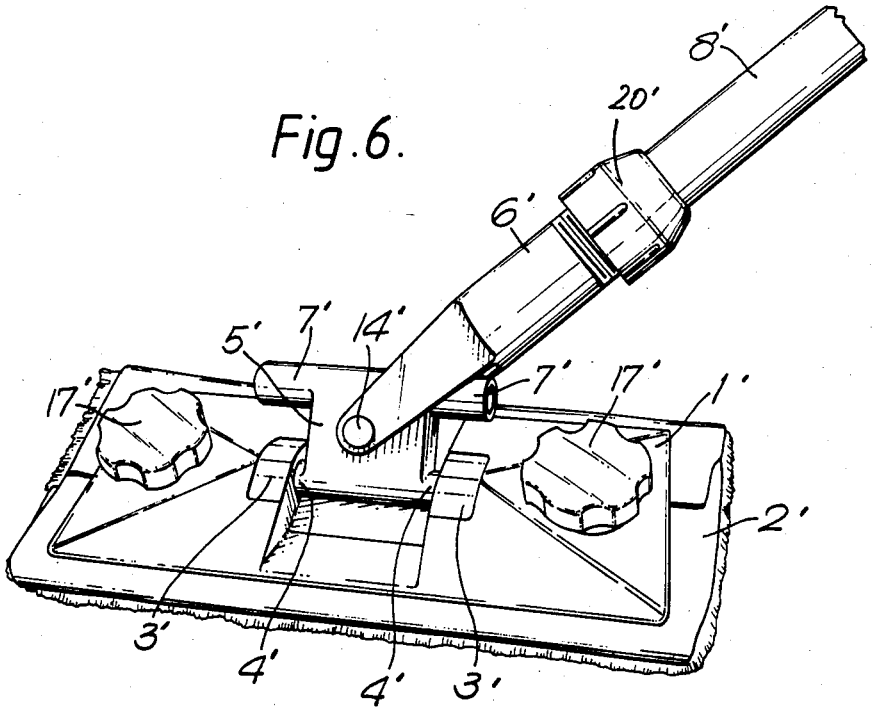

FIG. 6 is a view in perspective of the lower portion of a second preferred embodiment of a mop in accordance with the invention, the handle being drawn broken-off to enable larger scale drawing.

Figure 7:
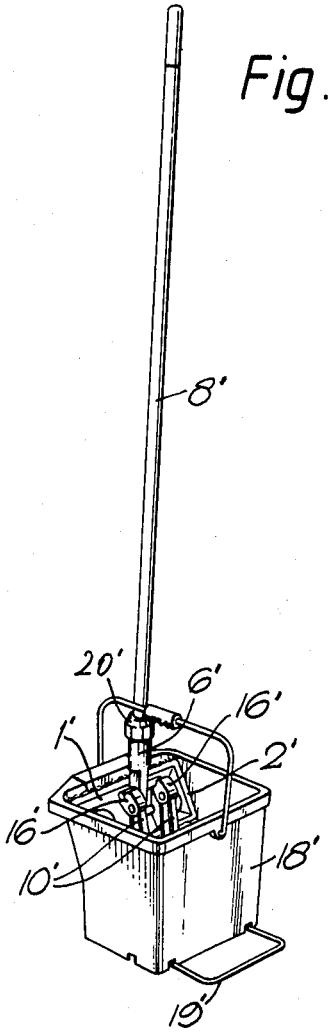

FIG. 7 is a view in perspective of the mop and squeeze combination of FIGS. 5 and 6, being positioned in a bucket.

Figure 8A:
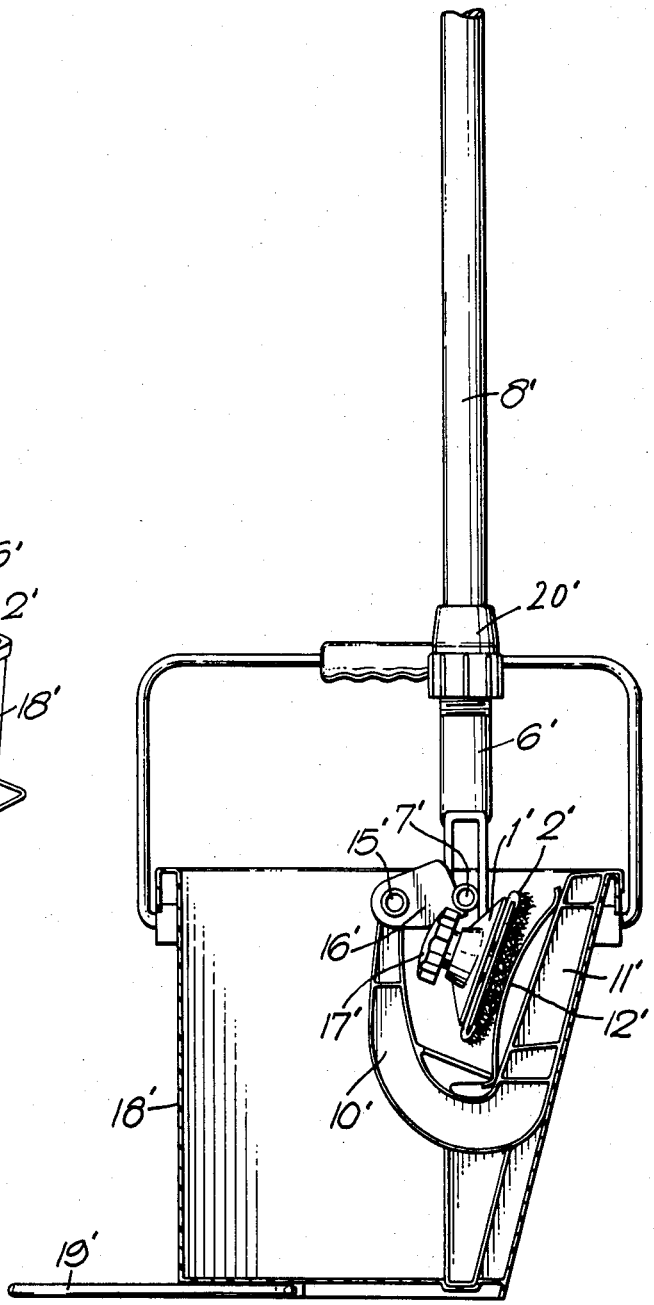
Figure 8B:
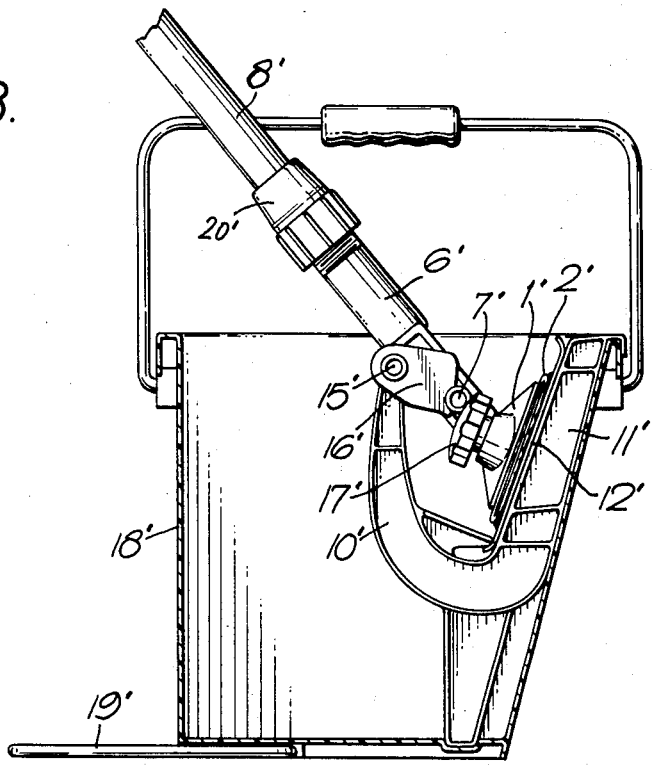

FIGS. 8*a* and 8*b* show, in enlarged side elevation the co-operation between the mop and the squeezing device of FIGS. 5 and 6, being positioned in a bucket.

A first preferred embodiment of the mopping device is illustrated in FIGS. 1 to 4.

An absorbent body 2 is attached to a flat backing plate 1 in a conventional manner, such as, for example, with an adhesive or via a clamping mechanism, the absorbent body being made of a flexible and absorbent material suitable for the purpose, such as, for example, sponge rubber. Hinge bridges 3 which pivotally clasp extending pins 4 of handle holder base 5 are rigidly attached to the upper side of plate 1. Handle holder 6 and lever arms 7 are rigidly attached to the handle holder base 5 in such a way that they form a rigid cranked lever. Handle holder base 5 and handle holder 6 form the lower end of handle 8, the handle holder 6 in general being a hollow, cylindrical tube, possibly tapering downwards, suitable for receiving and holding the rod part of handle 8 in a firm grip.

Co-operation between the hinge bridges 3 and handle holder base 5 results in handle 8 being able to pivot with respect to plate 1 in a plane that is perpendicular to the foot of the mop. In a preferred aspect, illustrated in FIG. 4, a second hinge 14 is incorporated in handle holder 6 acting perpendicularly to the first hinge device. In such an embodiment a universal joint is obtained, as a result of which handle 8 can be swivelled in all directions with respect to the foot.

Preferably, cam rolls 9 are incorporated on the ends of the lever arms 7, as a result of which the co-operation with arms 10 of the squeezing device, described in more detail below, is improved.

Figure 1:
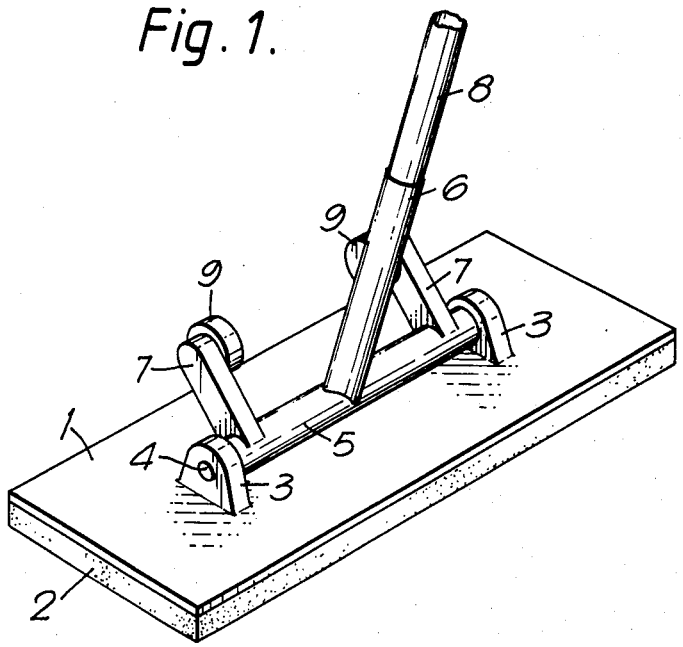
FIG. 1 is a view in perspective of the lower portion of a mop in accordance with the invention, the handle being drawn broken-off to enable larger scale drawing.
Figure 2:
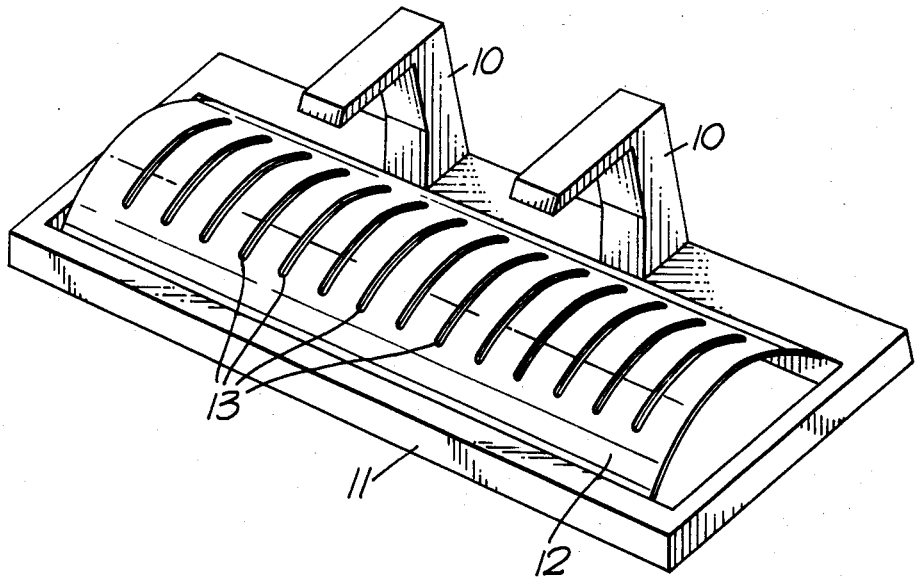
FIG. 2 is a view in perspective of a squeezing device, accessory to the mop of FIG. 1.

A preferred embodiment of a squeezing device is illustrated in FIG. 2. In general it consists of a holder comprising a frame 11 in which a squeezer plate 12 is positioned.

On the bottom side of frame 11 usual means are mounted with which the squeezing device can be non-slidably placed or clamped on a bucket or container. The number of squeezer arms 10 and the position thereof are such that they correspond with the number and the position of the lever arms on handle holder base 5. The lower side of the squeezer arms 10 may be flat but may also have a shape which co-operates with the cam rolls 9 or guides them, such as, for example, a groove, notch or side baffle. A preferred characteristic of the invention is the squeezer plate 12, which has a convex, preferably parabolic shape and is made of a strong, resilient material which, after deformation, returns to the original shape, such as, for example, metal. For draining of the dirty liquid the squeezer plate 12 is preferably provided with openings 13, for example in the form of grooves or round perforations. The squeezer plate may fit onto the frame 11 loosely or be clamped or screwed onto it at one side.

It is preferred that two lever arms 7 are incorporated, but it can also be advantageous to incorporate only one arm, which is then placed in the middle of handle holder base 5, while also more than two lever arms are possible, such as, e.g. three.

Preferably overhanging squeezer arms 10 are rigidly attached to frame 11, but an auxiliary abutment can be used instead, not attached to the frame, co-operable with arms 7 during the squeezing operation.

How the mop and the squeezing device co-operate during the squeezing-out operation is shown in side elevation in FIGS. 3*a, b* and *c*. In FIG. 3*a* it can be seen how the mop must be placed in the squeezing device, while FIGS. 3*b* and 3*c* indicate how the further the handle 8 is lowered, due to the co-operation of the squeezer arms 10 of the squeezing device and the cranked lever formed by lever arms 7 and handle 8 the absorbent body is squeezed over an increasingly greater part (F) of its surface and to an increasingly stronger extent on squeezer plate 12. At the beginning of the squeezing-out operation the squeezer plate 12 is not yet or only slightly deformed and the absorbent body is only squeezed in the middle. The further handle 8 is moved downwards, the greater is the force on squeezer plate 12, as a result of which the plate will deform to an increasing extent and, via the situation as shown in FIG. 3*b*, will ultimately squeeze the absorbent body 2 over the whole of its surface, as shown in FIG. 3*c*.

A second preferred embodiment of the mopping device is illustrated in FIGS. 5 to 8. The reference numbers have accents for reasons of clarity.

An absorbent body 2' comprising a mopping cloth, is attached to backing plate 1' by way of a clamping mechanism with securing knobs 17'. Hinge bridges 3' which pivotally clasp extending pins 4' of handle holder base 5' are rigidly attached to the upper side of plate 1'. Handle holder 6' is hingedly connected to handle holder base 5', the hinge 14' acting perpendicular to the first hinge device, the combination forming a universal joint. Sideways extending lever arms 7' are rigidly attached to handle holder base 5'. The rod part of handle 8' is received by handle holder 6' and secured by way of securing cap 20'.

A squeezing device suitable for vertical positioning in a container or bucket is illustrated in FIG. 5. It consists of a squeezer plate 12' with slots 13' and a holder therefor comprising a frame 11' and overhanging squeezer arms 10'. Hands 16' are hingedly connected to squeezer arms 10' by way of pivot pins 15' and suitable for receiving and cooperation with lever arm 7' of the mop.

The position of the mop and squeezing device in a bucket 18' with stabilizer member 19' is illustrated in perspective view in FIG. 7 and in enlarged side elevation in FIGS. 8*a* and 8*b*. In FIG. 8*b* is illustrated how the downward pivoting action of handle 8' results in deformation of squeezer plate 12' and according squeezing-out of absorbent body 2'.

By the invention the result is obtained that the absorbent body is squeezed in outward direction starting from the middle, as a result of which the soil is removed from the body together with the dirty liquid, complete squeezing out being achieved. A further result obtained is that as the force that has to be exerted during the squeezing-out operation becomes greater, the transmission of force by means of the lever mechanism becomes more favourable and the user needs to exert a relatively slighter force on the handle.

What is claimed is:

1. A mop comprising a backing plate, an absorbent body attached thereto, a handle pivotally connected to the backing plate by way of two perpendicularly acting hinge members, and one or more lever arms rigidly attached to the lower end of the handle, the combination of the handle and the arms forming a lever, the arms being co-operable with an auxiliary abutment located in suitable relation with a squeezing surface so that pivoting movement of the handle causes a downward pressure onto the backing plate for squeezing the absorbent body against the squeezing surface.

2. A mop according to claim 1 wherein the lever arms (7) extend angularly from the lower end of the handle (8) forming a cranked lever therewith.

3. A mop according to claim 1 wherein the lever arms (7') extend sideways from the lower end of the handle (8') forming a lever therewith.

4. A mop according to claim 2 wherein on the free ends of the lever arms (7) cam rolls (9) are incorporated.

5. A mop and squeezer combination comprising a mop according to claim 1 and an accessory squeezing device which comprises a squeezing plate capable of functioning as the squeezing surface, a holder for the plate, and one or more squeezer arms, rigidly attached to the holder and capable of functioning as the auxiliary abutment.

6. A combination according to claim 5 wherein the number of lever arms (7,7') is two.

7. A combination according to claim 5 wherein the squeezing plate (12,12') is arcuate.

8. A combination according to claim 5 wherein the squeezing plate (12,12') is perforated.

9. A combination according to claim 5 wherein hands (16') which are suitable for receiving and cooperation with the lever arms (7') are hingedly connected to the ends of the squeezer arms (10').

* * * * *